US006876907B2

(12) United States Patent
Kanner et al.

(10) Patent No.: US 6,876,907 B2
(45) Date of Patent: Apr. 5, 2005

(54) REMOTE RESTART FOR AN ON-BOARD TRAIN CONTROLLER

(75) Inventors: Abe Kanner, Mississauga (CA); Vlad Mitroi, Mississauga (CA)

(73) Assignee: Alcatel, Paris (FR)

( * ) Notice: Subject to any disclaimer, the term of this patent is extended or adjusted under 35 U.S.C. 154(b) by 6 days.

(21) Appl. No.: 10/619,631

(22) Filed: Jul. 16, 2003

(65) Prior Publication Data

US 2005/0027410 A1 Feb. 3, 2005

(51) Int. Cl.[7] ..... G06F 17/00; B61L 1/00

(52) U.S. Cl. ..... 701/19; 701/29; 246/169 R

(58) Field of Search ..... 701/33, 117, 2, 701/19, 20, 24, 29; 246/3, 14, 15, 169 R, 5

(56) References Cited

U.S. PATENT DOCUMENTS

| | | | | |
|---|---|---|---|---|
| 3,575,594 A | * | 4/1971 | Elcan | 246/2 R |
| 4,023,753 A | | 5/1977 | Dobler | |
| 4,994,969 A | * | 2/1991 | Petit | 701/19 |
| 5,042,439 A | | 8/1991 | Tholl et al. | |
| 5,309,664 A | | 5/1994 | Wright | |
| 5,332,180 A | | 7/1994 | Peterson et al. | |
| 5,513,244 A | | 4/1996 | Joao et al. | |
| 5,751,569 A | | 5/1998 | Metal et al. | |
| 5,794,172 A | | 8/1998 | Matheson et al. | |
| 5,884,144 A | | 3/1999 | Chavez, Jr. et al. | |
| 6,135,396 A | * | 10/2000 | Whitfield et al. | 246/182 R |
| 6,140,939 A | | 10/2000 | Flick | |
| 6,144,315 A | | 11/2000 | Flick | |
| 6,195,020 B1 | | 2/2001 | Brodeur, Sr. et al. | |
| 6,633,784 B1 | * | 10/2003 | Lovelace et al. | 700/65 |
| 6,799,097 B2 | * | 9/2004 | Villarreal Antelo et al. | 701/19 |
| 2002/0062182 A1 | * | 5/2002 | Sato et al. | 701/19 |

OTHER PUBLICATIONS

Hampton et al.; Railway power SCADA system commissioning "Case Example"; Asia–Pacific Confernece on Quality Software, 2001; IEEE 2001; pp. 185–193.*

Collis, L.; Making sense of remote condition monitoring for operations and incident management; IEE Seminar on Condition Monitoring for Rail Transportation Systems; Nov. 1998; pp. 14/1–14/5.*

What is Scada?, by Alex Daneels, Wayne Salter, IT/CO; http://ref.cern.ch/CERN/CNL/2000/003/scada/; Apr. 24, 2003.

* cited by examiner

*Primary Examiner*—Michael J. Zanelli
(74) *Attorney, Agent, or Firm*—Sughrue Mion, PLLC; V. Lawrence Sewell

(57) ABSTRACT

A automatic train control system (ATCS) in which a driverless vehicle is reset remotely upon detection of a failure in an on-board controller. If the direction of the train has not changed, and none of the train doors were opened, during the time the train was disabled due to the failure, the train is controlled to resume automatic operation.

9 Claims, 1 Drawing Sheet

REMOTE RESTART FOR AN ON-BOARD TRAIN CONTROLLER

BACKGROUND OF THE INVENTION

Modern guideway transportation systems typically utilize Automatic Train Control Systems (ATCS) that feed various data to automatic control systems on-board the trains. Data is provided to controllers located on-board the trains and includes both direct control data used to control the actions of the respective trains and communication data used to communicate system-related information relative to the overall transportation system.

At various times during the operation of the ATCS, the on-board controller of a given train might fail. For example, a failure of a controller might include an event related to the hardware or software of the system that prevents the on-board controller from performing Automatic Train Operation (ATO) or Automatic Train Protection (ATP) functions.

The ATP functionality ensures safe train movement. For instance, ATP is designed into an ATC system to prevent rear-end, head-on, and sideswipe collisions due to conflicting train movements; passenger hazards due to unscheduled door openings; and damage or collisions caused by improper guideway switch movements/settings, or trains exceeding the allowed civil limit, or commanded, speeds.

ATO performs required non-vital functions such as speed regulation, programmed stopping, door control and performance level regulation. ATO commands are always subordinate to the ATP subsystem supervision. The ATO subsystem of the ATC system is primarily designed to provide regulation command of the train speed within the limits imposed by the ATP subsystem and to provide train movement within the passenger ride quality criteria as established by operating policy. Additionally, the ATO subsystem controls station dwell-time control, i.e., the amount of time any given train is permitted to stand idle at a station; on-board station arrival display control; and train audio announcement control.

In most, if not all, conventional ATC systems, once a failure occurs with respect to the on-board controller, it is necessary to dispatch a maintenance crew to the failed train to reset the failed controller. Manual intervention of this nature requires a significant amount of time, including time to detect the failure, time for the maintenance crew to travel to the guideway station closest to the train with the failed controller, time for the crew to travel on the guideway from the station to the disabled train and time for the crew to actually reset the controller and place the train in an operable condition. This process can take anywhere from approximately 40 minutes, or more, on average to recover a failed train.

Furthermore, after the controller is reset, the train must be manually driven until its relative position within the overall transportation system is established and automatic operation and control of the train can resume. Accordingly, failed on-board controllers result in delays and operational mode changes in addition to the penalties associated with these delays and changes. The penalties include passenger frustration and the hazards associated with passengers navigating the guideway, e.g., if passengers disembark the train prior to the train arriving at a station.

One solution to the above-mentioned problems is proposed in U.S. Pat. No. 4,023,753 to Dobler. In Dobler, a control system for controlling driverless vehicles on a fixed guideway is disclosed. One of the safety features in the Dobler system is a so-called operations monitor alarm (OMA). The OMA protects the system against abnormal operation and provides a signal to warn of abnormality. Once activated, the OMA brings instruction execution to a steady halt and changes the system safe signal to the unsafe condition. According to Dobler, the OMA can be cleared by auto-restart or by manually pressing the system reset switch at the computer console. If the OMA is cleared by the system reset switch, the program must be restarted manually.

The Dobler system, however, still suffers from some of the same problems mentioned above in regard to other conventional systems. For example, the Dobler system still requires that the train be manually driven to establish the train's relative position within the transportation system.

SUMMARY OF THE INVENTION

The present invention addresses the problems mentioned above associated with conventional train control systems.

For example, in accordance with one embodiment of the invention, a method of controlling an automatic vehicle control system for a vehicle traveling on a guideway is proposed. The method includes detecting a failure state in an on-board controller of a train and as a result sending a restart command from a remote central controller to equipment, such as SCADA, on-board the vehicle. Once the restart command has been received, for example over a wireless communication link, the SCADA automatically sends a reset command to the on-board controller.

After the reset is received by the on-board controller it is determined whether a direction of travel of the vehicle was changed during a time of failure. If the direction was not changed since the time of the failure, automatic vehicle control operation is resumed. Also, after the reset is received by the on-board controller, it is determined whether any of the doors of the vehicle, doors that permit passengers to enter or exit the vehicle, were opened since the time of the controller failure. If none of the doors were opened during the time of failure, automatic control is permitted to resume. On the other hand, if any of the doors were opened, or the vehicle changed directions, during the time of failure, a manual reset is required.

DETAILED DESCRIPTION OF THE INVENTION

Figure 1:
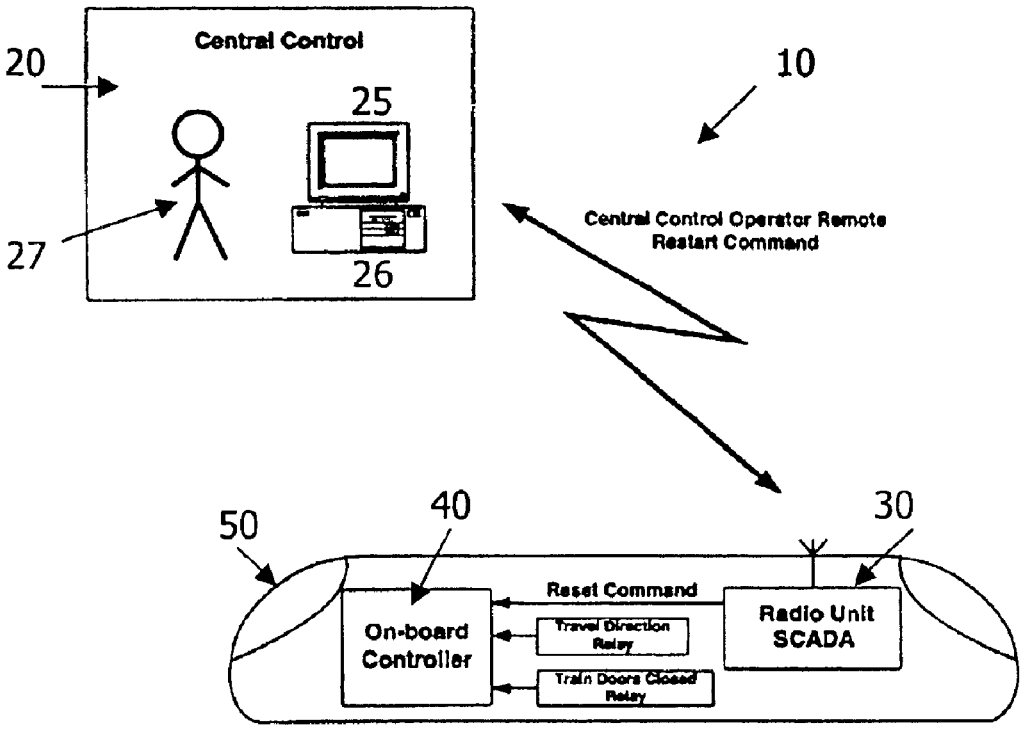
FIG. 1 is an illustration of a train control system in accordance with the present invention.

As illustrated in FIG. 1, a train control system 10 in accordance with the present invention includes a central controller 20 including a computer 25 with a processor 26, an on-board radio unit 30, for example used in SCADA, and an on-board controller 40. The term "on-board" refers to that equipment which is physically located on a guideway vehicle 50, such as a train.

During normal operation of the train control system in accordance with the present invention, the on-board controller 40 communicates with the central controller 20, for example, over a wireless communication link. The communication between the on-board controller 40 and the central controller 20 enables controller 20 to perform ATP and ATO functions, as discussed above, as well as Automatic Train Supervision (ATS) functions.

ATS functions include monitoring and displaying the location of various trains and the health status of all ATC components; regulating the operation of the trains within the system; establishing a man-machine interface; routing trains based on destination/run and schedule assignments; requesting switch moves and train reversals in accordance with destination/run assignments for various trains; modifying the system operating parameters, such as dwell times and maximum speeds in response to system delays and/or commands from a central operator; interfacing with communication subsystems and displays; collecting data for management reports; and interfacing with the station platform information displays and announcement systems.

As long as everything is running smoothly, that is, there are no failures in any of the ATO, ATP or ATS functions, the trains within the system run virtually without intervention from the central control operator 27. However, once a problem arises in any of these functions, the on-board controller 40 of the effected train or trains is disabled, thus disabling the train, until the controller is reset.

Specifically, according to one embodiment of the present invention, the central controller 20 systematically performs systems checks to verify proper functioning of each of the ATO, ATP and ATS systems with respect to various trains in the overall ATC system. If a failure in any of these functional systems is detected in any of the trains, which resulted in the automatic disabling of the respective on-board controller 40, the central controller 20, via the central control operator 27, issues a restart command to the effected train or trains. The restart command is transmitted from the remotely located central controller 20 to, for example, the radio unit 30, which can be part of a SCADA system, located onboard the particular train or trains 50 exhibiting the failure.

After receiving the restart command from the central controller 20, the SCADA 30 transmits a reset command to the failed on-board controller 40. After receiving the reset command from the SCADA 30, the on-board controller runs through its reset procedure. In particular, once the on-board controller 40 receives the reset command, it determines whether the travel direction of the train 50 changed during the time of the failure, i.e., during the time the controller 40, and hence the train 50, was disabled. This check is performed to ensure that the train was not driven manually during the time of failure in the opposite direction to that which it was originally traveling prior to the failure. For example, whether or not the train has moved in the opposite direction during the time of failure is determined by the travel direction relay which is also used to command movement of the train after the reset.

In addition to checking the direction of movement of the train, controller 40 also checks the door closure status via the train door relay to determine if any of the train doors were opened during the time of the controller failure. This information assists in determining whether passengers have attempted to leave or have left the train during the failure. If passengers have exited the train, they might be on the guideway and caution should be used before the train is once again set in motion.

If the direction of travel was not changed and the train doors were not opened during the time the controller 40 was disabled, the on-board controller 40 will then command the train to travel at a slow speed, e.g., approximately 5 km/h, in order to establish position. Establishing position requires the controller 40 to detect two positioning markers that are disposed approximately 50 meters apart on the trackside.

Specifically, relative train position determination can be accomplished using a combination of wayside and on-board devices. These devices include transponders, a Transponder Interrogator (TI) unit and two independent tachometers.

Passive transponder tags are mounted on the guideway at locations corresponding to codes in the ATP database. Each time the train passes a guideway transponder, the TI unit receives the transponder's uniquely coded ID. At this time, the TI unit serially passes the transponder ID to the ATP Unit for processing. The ATP Unit verifies that the transponder ID received is valid using the following criteria: the transponder ID exists in the ATP database; the transponder ID received was expected based on the previous transponder IDs received; and the transponder was received within the appropriate distance after the previous transponder. The guideway position associated with the verified unique transponder ID is then retrieved from a stored table. This position is used for the absolute position of the train.

Fine positioning between transponders is determined from the input of the two independent tachometers. The distance input from the two tachometers is compared to ensure that no large discrepancy exists between them. If a significant discrepancy is detected, the train is "emergency-braked" and the position of the train is set to "undetermined."

To further verify the tachometer distance inputs, the tachometer velocity inputs are integrated to determine the distance traveled by the train. If a discrepancy exists between the registered tachometer distance inputs and the integrated tachometer velocity inputs, the train is again "emergency-braked" and the position of the train is set to "undetermined."

The direction of movement can be established from the information stored in the ATP database and a sequence of the transponder IDs. Also, the information provided by the tachometers on the train includes direction information. Once the position of the train is established, the controller may resume automatic operation.

If, however, it is determined that during the time of the controller failure the original travel direction was changed or the train doors have been opened, or if the train travels after being reset for a predetermined distance without its position being established, the automatic restart is abandoned and a manual restart is required.

The above description of the preferred embodiment has been given by way of example. From the disclosure given, those skilled in the art will not only understand the present invention and its attendant advantages, but will also find apparent various changes and modifications to the structures and methods disclosed. It is sought, therefore, to cover all such changes and modifications as fall within the spirit and scope of the invention, as defined by the appended claims, and equivalents thereof.

What is claimed is:

1. A method of controlling an automatic vehicle control system for a vehicle traveling on a guideway, the method comprising:

detecting a failure state in an on-board controller of the vehicle;

sending a restart command from a remote central controller to equipment on-board the vehicle;

sending a reset command to the on-board controller;

determining whether a direction of travel of the vehicle was changed during a time of failure; and resuming automatic vehicle control operation if the direction of travel was not changed.

2. A method as claimed in claim 1, wherein the restart command sent from the remote central controller is sent via a wireless communication network.

3. A method as claimed in claim 1, further comprising:

determining whether a door permitting passengers to exit the vehicle was opened during the time of failure; and resuming automatic vehicle control operation if the door permitting passengers to exit the vehicle was not opened.

4. A method as claimed in claim 1, further comprising:

manually resetting the on-board controller if it is determined that the direction of travel was changed.

5. A method as claimed in claim 1, wherein the equipment on-board the vehicle to which the restart command is sent comprises a portion of a SCADA system.

6. A method as claimed in claim 1, further comprising:

commanding the vehicle to travel at a constant low speed after the controller has been reset if it is determined that the direction of travel was not changed during the failure.

7. A method as claimed in claim 6, further comprising:

detecting at least two positioning markers disposed on the guideway to establish a position of the vehicle.

8. An automatic vehicle control system for controlling a vehicle on a guideway, the system comprising:

an on-board controller located on the vehicle;

a radio unit located on the vehicle and operable to communicate with said on-board controller; and a central controller located remote from said vehicle and operable to transmit a restart command to said radio unit upon detection of a failure state in said on-board controller;

wherein said ratio unit provides a reset command to said on-board controller after receiving the restart command and operation is resumed in the on-board controller if it is determined that the vehicle has not changed travel directions since the time of the failure.

9. An automatic vehicle control system as claimed in claim 8, wherein further, operation is resumed in the on-board controller if it is determined that doors permitting passengers to disembark the vehicle were not opened since the time of the failure.

* * * * *